US005220118A

United States Patent [19]

Konishi

[11] Patent Number: 5,220,118

[45] Date of Patent: Jun. 15, 1993

[54] AUTO-PLAY MUSICAL INSTRUMENT WITH A DIAL FOR CONTROLLING TONE-UP LEVEL OF AUTO-PLAY TONES

[75] Inventor: Shinya Konishi, Hamamatsu, Japan

[73] Assignee: Kabushiki Kaisha Kawai Gakki Seisakusho, Shizuoka, Japan

[21] Appl. No.: 933,117

[22] Filed: Aug. 21, 1992

[30] Foreign Application Priority Data

Sep. 6, 1991 [JP] Japan ..... 3-254423

[51] Int. Cl.[5] ..... G10H 1/38; G10H 1/42

[52] U.S. Cl. ..... 84/609; 84/633; 84/DIG. 12; 84/DIG. 22

[58] Field of Search ..... 84/609-614, 84/634-638, 649-652, 666-669, 633, 665, DIG. 12, DIG. 22

[56] References Cited

U.S. PATENT DOCUMENTS 4,152,964 5/1979 Waage ..... 84/DIG. 22
4,248,119 2/1981 Yamada ..... 84/DIG. 22
4,646,609 3/1987 Teruo et al. ..... 84/609 X

*Primary Examiner*—Stanley J. Witkowski

[57] ABSTRACT

An auto-play musical instrument, which can give a tone-up state of a music piece intended by a player at his or her intended timing is disclosed. When a rotational speed detector (60) detects that a dial (10) is rotated at a speed higher than a predetermined speed, a director (63) directs a pattern selector (65) to select a soft fill-in pattern or a loud fill-in pattern in place of increment-/decrement of an intonation value by a value changer (64). An auto-play operation is made based on the selected pattern, thereby sharply changing the tone-up level of play tones.

4 Claims, 7 Drawing Sheets

FIG. 3

| RHYTHM | INTONATION PRESET VALUE |
|---|---|
| 1 | 2 |
| 2 | 4 |
| 3 | 3 |
| ⋮ | ⋮ |

41

FIG. 4

| RHYTHM | INTONATION PATTERN | | | | |
|---|---|---|---|---|---|
| | 0 | 1 | 2 | ------ | 15 |
| 1 | | | | ------ | |
| 2 | | | | ------ | |
| 3 | | | | ------ | |
| ⋮ | | | | ------ | |

34a

42

34

A
S10
SOFT FILL-IN?
YES
NO
S11
LOUD FILL-IN?
YES
NO
S12
+1REQ?
YES
NO
S13
-1REQ?
YES
NO
S17
INT -1
S16
INT +1
S14
SET ADRS OF SOFT FILL-IN DATA
DSPL INT VALUE
S18
S15
SET ADRS OF LOUD FILL-IN DATA
SET INT CHG FLAG
S19
RHYTHM ON?
YES
NO
S20
S21
TIMING TO READ OUT DATA?
YES
NO
S22
INT CHG FLAG ON?
YES
NO
S23
RESET ADRS
READ OUT DATA
S24
TONE GENERATION/ TONE EXTINCTION
S25
B

AUTO-PLAY MUSICAL INSTRUMENT WITH A DIAL FOR CONTROLLING TONE-UP LEVEL OF AUTO-PLAY TONES

BACKGROUND OF THE INVENTION

1. Field of the Invention

The present invention relates to an auto-play apparatus and, more particularly, to an auto-play musical instrument capable of obtaining auto-play tones having different tone-up levels by modifying programmed auto-play data.

2. Description of the Related Art

As an auto-play musical instrument capable of obtaining auto-accompaniment tones having a tone-up level intended by a player by modifying programmed auto-play data, for example, a musical instrument described in Japanese Patent Application No. 3-58188 has been proposed. In the musical instrument described in this patent application, when a dial-like operation member provided to the auto-play musical instrument is rotated, the intonation value is changed upon rotation of the operation member, and tone parameters of auto-play data are modified according to the change in intonation value. In consideration of operability, and the like, when the dial-like operation member is rotated through more than a ⅓ revolution, the intonation value is incremented/decremented by one.

The musical instrument of the above-mentioned patent application is suitable for gradually providing a tone-up state of play tones. However, when the tone-up level is to be sharply changed, the dial-like operation member must be rotated a number of times. Thus, a timing for setting an intonation value capable of obtaining a tone-up level of play tones intended by a player is delayed. Therefore, it is difficult to obtain play tones having a tone-up level intended by a player at his or her intended timing.

SUMMARY OF THE INVENTION

It is, therefore, an object of the present invention to provide an auto-play musical instrument, which can obtain auto-play tones having a tone-up level intended by a player at his or her intended timing when the player wants to give a sharp change to the tone-up state of auto-play tones.

According to the present invention, there is provided an auto-play musical instrument for generating tones on the basis of programmed auto-play data, comprising a dial-like operation member for changing an intonation value indicating a tone-up level of play tones, intonation value incrementing/decrementing means for incrementing/decrementing the intonation value according to a rotational angle of the dial-like operation member, tone parameter modifying means for modifying tone parameters of the auto-play data according to the intonation value set upon operation of the dial-like operation member, rotational speed detection means for detecting a rotational speed of the dial-like operation member, play pattern memory means for storing auto-play patterns for tone generation of fill-in pieces, which patterns are used for sharply changing the tone-up level of play tones, direction means for, when it is determined as a result of detection by the rotational speed detection means that the rotational speed of the dial-like operation member is higher than a predetermined speed, directing an auto-play operation based on the auto-play pattern for tone generation of the fill-in piece, and for, when it is determined that the rotational speed of the dial-like operation member is lower than the predetermined speed, directing the intonation value incrementing/decrementing means to increment/decrement the intonation value, and tone generation means for, when the direction means directs the auto-play operation based on the auto-play pattern for tone generation of the fill-in piece, reading out the auto-play pattern from the play pattern memory means, and performing the auto-play operation on the basis of the readout auto-play pattern.

The auto-play musical instrument may further comprise rotating direction detection means for detecting a rotating direction of the dial-like operation member, and designation means for designating a type of auto-play pattern for tone generation of the fill-in piece to be read out from the play pattern memory means according to the rotating direction of the dial-like operation member detected by the rotating direction detection means.

According to the present invention, there is also provided an auto-play musical instrument for performing an auto-play operation on the basis of programmed auto-play data, comprising a dial-like operation member for changing an intonation value indicating a tone-up level of play tones, intonation value incrementing/decrementing means for incrementing/decrementing the intonation value according to a rotational angle of the dial-like operation member, rotational speed detection means for detecting a rotational speed of the dial-like operation member, direction means for, when it is determined as a result of detection by the rotational speed detection means that the rotational speed of the dial-like operation member is higher than a predetermined speed, directing to set a preset value as the intonation value, and for, when it is determined that the rotational speed of the dial-like operation member is lower than the predetermined speed, directing the intonation value incrementing/decrementing means to increment/decrement the intonation value, intonation value setting means for setting the intonation value according to a direction from the direction means, and tone parameter modifying means for modifying tone parameters of the auto-play data according to the intonation value set by the intonation value setting means.

According to the present invention, there is also provided an auto-play musical instrument for performing an auto-play operation on the basis of programmed auto-play data, comprising a dial-like operation member for changing an intonation value indicating a tone-up level of play tones, intonation value incrementing/decrementing means for incrementing/decrementing the intonation value according to a rotational angle of the dial-like operation member, rotational speed detection means for detecting a rotational speed of the dial-like operation member, direction means for, when it is determined as a result of detection by the rotational speed detection means that the rotational speed of the dial-like operation member is higher than a predetermined speed, directing to add a predetermined value to the intonation value set at that time, and for, when it is determined that the rotational speed of the dial-like operation member is lower than the predetermined speed, directing the intonation value incrementing/decrementing means to increment/decrement the intonation value, intonation value setting means for setting the intonation value according to a direction from the direction means, and tone parameter modifying means for modifying tone parameters of the auto-play data according to the intonation value set by the intonation value setting means.

According to the present invention, when the dial-like operation member is rotated at a speed higher than a predetermined speed (sharply) during an auto-play operation is performed based on programmed auto-play data, an auto-play operation based on an auto-play pattern for tone generation of a fill-in piece stored in the auto-play pattern memory means. Thus, the tone-up level of the music piece played so far can be sharply changed. When the auto-play musical instrument is arranged such that the type of an auto-play pattern for tone generation of a fill-in piece to be read out from the auto-play pattern memory means can be designated by the designation means according to the rotating direction of the dial-like operation member, if the dial-like operation member is rotated clockwise, an auto-play pattern for tone generation of a fill-in piece, which pattern sharply increases the tone-up level of the play tones, is designated; if it is rotated counterclockwise, an auto-play pattern for tone generation of a fill-in piece, which pattern sharply suppresses the tone-up level of the play tones, is designated.

When the auto-play musical instrument is arranged such that a preset value is set as an intonation value when the dial-like operation member is rotated at a speed higher than a predetermined speed, if a large value is set as the preset value, the intonation value can be largely changed at a time, thus providing a sharp change to the tone-up state of the play tones.

Furthermore, when the auto-play musical instrument is arranged such that a predetermined value is added to the current intonation value to set a new intonation value when the dial-like operation member is rotated at a speed higher than a predetermined speed, if a large value is set as the predetermined value, the intonation value can also be largely changed at a time, thus providing a sharp change to the tone-up state of play tones.

BRIEF DESCRIPTION OF THE DRAWINGS

FIG. 3 is a view for explaining a memory table of intonation preset values;

FIG. 4 is a view for explaining memory tables of intonation pattern data;

DETAILED DESCRIPTION OF THE PREFERRED EMBODIMENT

Figure 1:
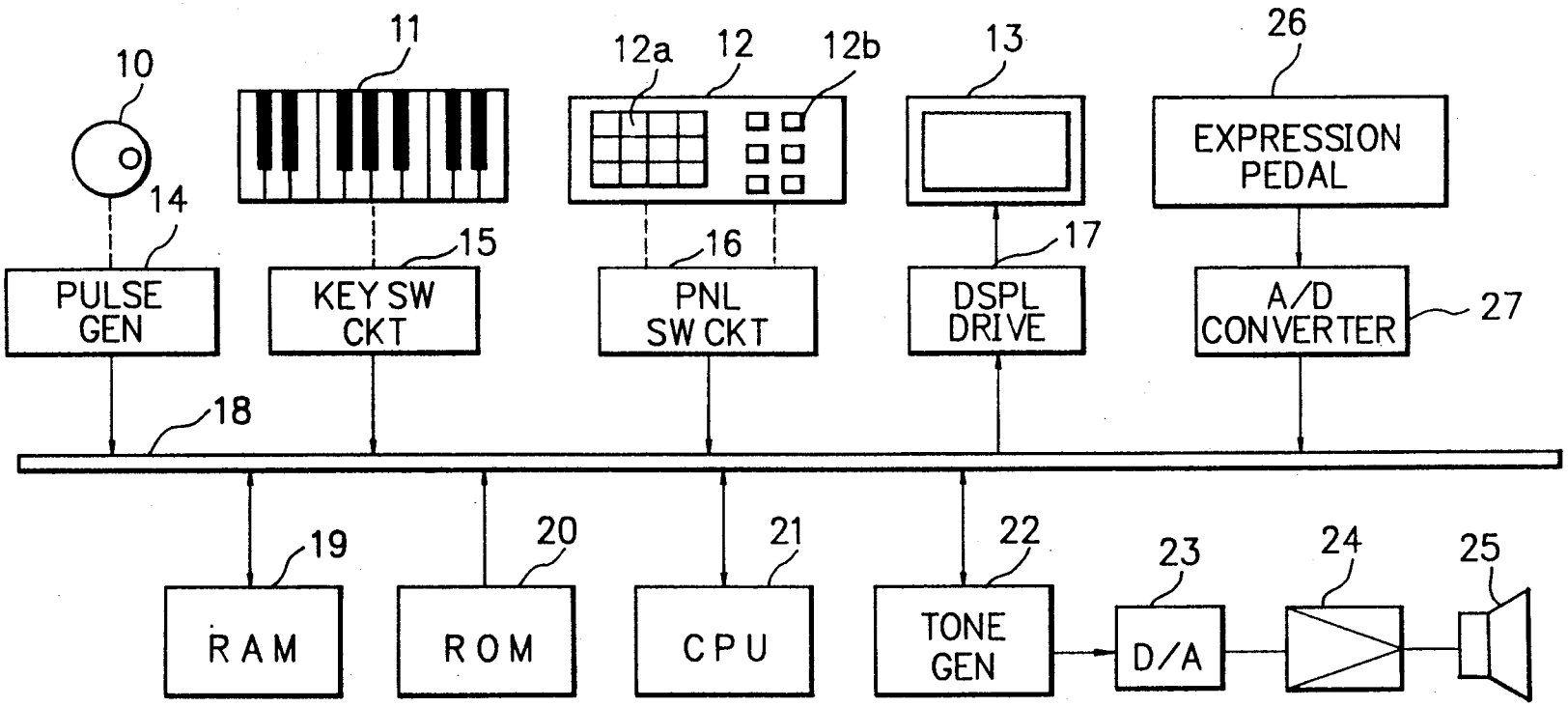
FIG. 1 is a block diagram showing an electronic musical instrument according to an embodiment of an auto-play musical instrument of the present invention.

FIG. 1 is a block diagram showing principal part of an electronic musical instrument according to an embodiment of the present invention. This electronic musical instrument comprises a keyboard 11, an operation panel 12, and a display 13. A dial 10 for directing the tone-up level of play tones is arranged aside the keyboard 11.

The circuit portion of the electronic musical instrument comprises a microcomputer consisting of a CPU 21, a ROM 20, and a RAM 19, which are connected through a bus 18. The CPU 21 detects operation information of the keyboard 11 from a key switch circuit 15 connected to the keyboard 11, and detects operation information of panel switches from a panel switch circuit 16 connected to the operation panel 12. The dial 10 is connected to a pulse generator 14. The CPU 21 counts pulses generated by the pulse generator 14 according to the operation of the dial 10, thus obtaining tone-up level information (intonation value).

The rhythm and type of instrument selected at the operation panel 12, the intonation value corresponding to the dial operation, and the like are displayed on the basis of display data supplied from the CPU 21 to the display 13 through a display drive 17.

The CPU 21 sends note data corresponding to the keyboard operations, and parameters such as the rhythm, tone color, and the like corresponding to the panel switch operations to a tone generator 22. The tone generator 22 reads out PCM tone source data from the ROM 20 on the basis of these data, processes the amplitude or envelope of the readout data, and outputs the processed data to a D/A converter 23. Tone signals obtained from the D/A converter 23 are supplied to a loudspeaker 25 through an amplifier 24.

The ROM 20 stores auto-accompaniment (auto-play) data. The CPU 21 reads out auto-accompaniment data corresponding to an operation of an auto-accompaniment selection button on the operation panel 12, and supplies the readout data to the tone generator 22. The tone generator 22 reads out waveform data such as chord, bass, drum data, and the like corresponding to the auto-accompaniment data from the ROM 20, and supplies the readout data to the D/A converter 23. Therefore, auto-accompaniment tones, i.e., chord, bass, and drum tones are obtained from the loudspeaker 25 together with tones corresponding to key operations.

An expression pedal 26 is an operation member, which is operated when a player depresses it with his or her foot like a piano pedal. The expression pedal 26 is a pedal having a seesaw-like structure. When the player depresses one of the end portions of the pedal with respect to the fulcrum at the central portion of the pedal, the tone-up level of play tones is directed. When the expression pedal is depressed, the value of a resistor (not shown) connected to the pedal changes, and this resistance is converted into digital data by an A/D converter 27. The digital data is supplied as intonation value setting information to the CPU 21.

Figure 2:
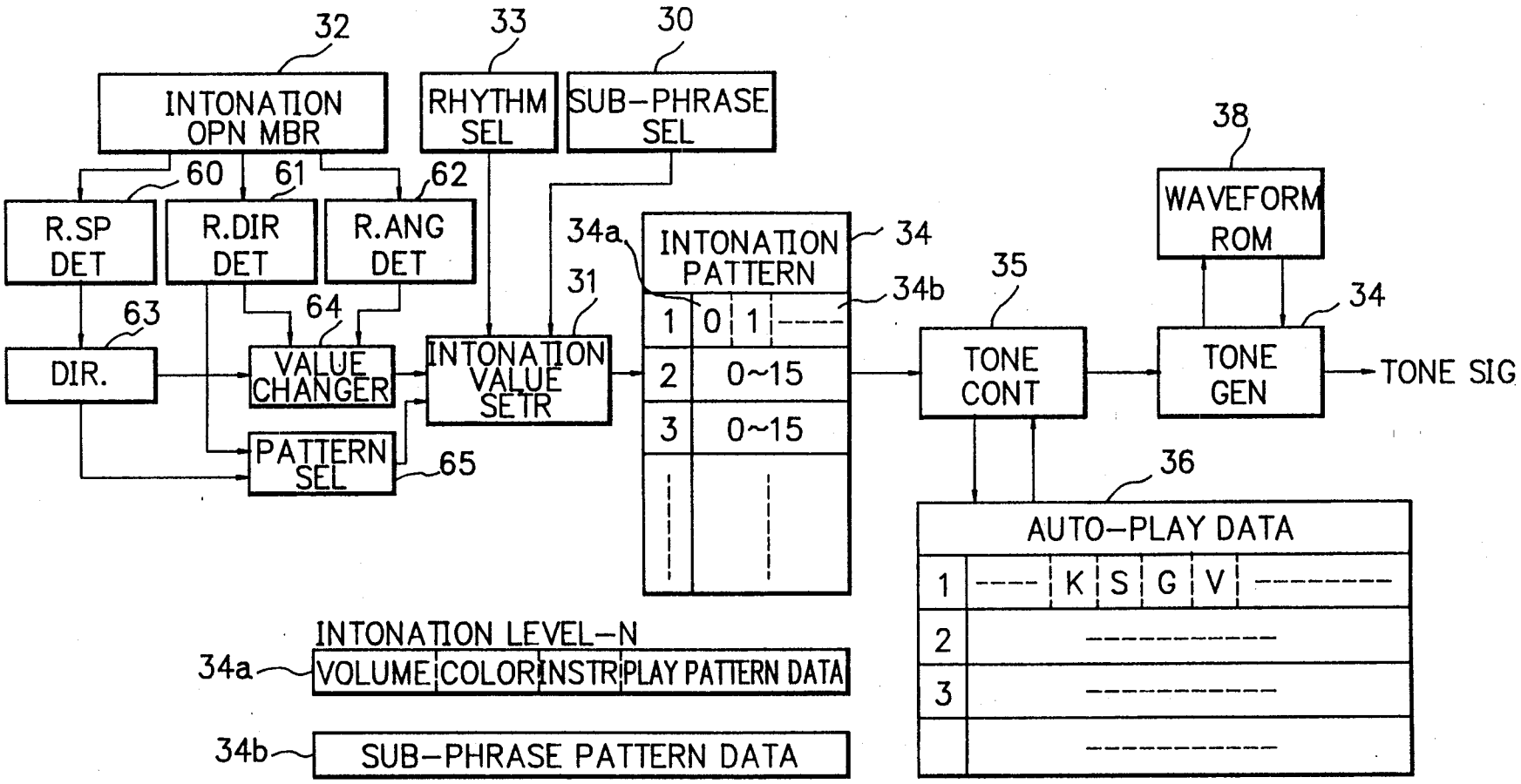
FIG. 2 is a block diagram showing elemental features of the auto-play musical instrument of the present invention.

FIG. 2 is a block diagram showing elemental features of the present invention. An intonation operation member 32 corresponds to the dial 10 and the pulse generator 14 shown in FIG. 1. A rhythm selector 33 comprises ten-key switches **12*a* provided to the operation panel 12. The operation panel 12 is also provided with a plurality of push-button switches 12*b* for directing insertion of a sub-phrase pattern of a single phrase consisting of a note data string for several bars such as an introduction pattern, an ending pattern, a fill-in pattern, and the like. These push-button switches 12*b* constitute a sub-phrase selector 30 shown in FIG. 2**.

When the dial 10 is operated according to the tone-up state of play tones, a rotational speed detector 60, a rotating direction detector 61, and a rotational angle detector 62 respectively detect the rotational speed, rotating direction, and rotational angle of the dial 10 on the basis of output pulses from the pulse generator 14. If it is determined as a result of detection by the rotational speed detector 60 that the rotational speed of the dial 10 is lower than a predetermined speed, a director 63 directs a value changer 64 to increment/decrement the intonation value according to the rotational angle of the dial 10; if it is determined that the rotational speed of the dial 10 is higher than the predetermined speed, the director 63 directs a pattern selector 65 to select a soft or loud fill-in pattern (to be described later).

The value changer 64 increments/decrements the current intonation value by one according to the rotational angle of the dial 10, e.g., in response to a ⅛ revolution of the dial 10. Whether the value is incremented or decremented is determined according to the rotating direction of the dial 10. That is, when the dial 10 is rotated clockwise, the value is incremented; when it is rotated counterclockwise, the value is decremented.

The pattern selector 65 sends selection direction information of a fill-in pattern to an intonation value setter 31 according to the rotating direction of the dial 10. For example, when the dial 10 is rotated clockwise, the selector 65 sends selection direction information of a loud fill-in pattern to the intonation value setter 31; when it is rotated counterclockwise, the selector 65 sends selection direction information of a soft fill-in pattern to the setter 31.

The intonation value setter 31 receives a selected rhythm number from the rhythm selector 33, and also receives sub-phrase selection information from the sub-phrase selector 30. The intonation value setter 31 has an intonation preset table 41 allocated on the ROM 20, as shown in FIG. 3. This table 41 has intonation preset values in units of rhythms. For example, an intonation level "2" is assigned to a rhythm "1". The intonation preset value is incremented/decremented by the value changer 64 according to the dial operation. The intonation value and the rhythm number are supplied to an intonation pattern memory 34. When the pattern selector 65 selects a soft or loud fill-in pattern according to the direction from the director 63, the intonation value setter 31 sets an intonation value (OAH, OCH) for specifying the selected pattern.

The intonation pattern memory 34 is allocated on the ROM 20, and has a plurality of levels (e.g., 16; 0 to 15) intonation pattern tables 42 corresponding to intonation values in units of rhythms, as also shown in FIG. 4. Intonation pattern data 34*a* of a predetermined level corresponding to the selected rhythm and the input intonation value is read out from the memory 34, and is supplied to a tone controller 35. For example, when the selected rhythm number is "1", and the intonation value is "2", the intonation pattern data 34*a* of the corresponding level "2" is read out.

The intonation pattern data is partially used as a sub-phrase pattern 34*b*. The sub-phrase pattern 34*b* is read out when a sub-phrase (single phrase) such as an introduction pattern, an ending pattern, a fill-in pattern, or the like is inserted.

Figure 5:
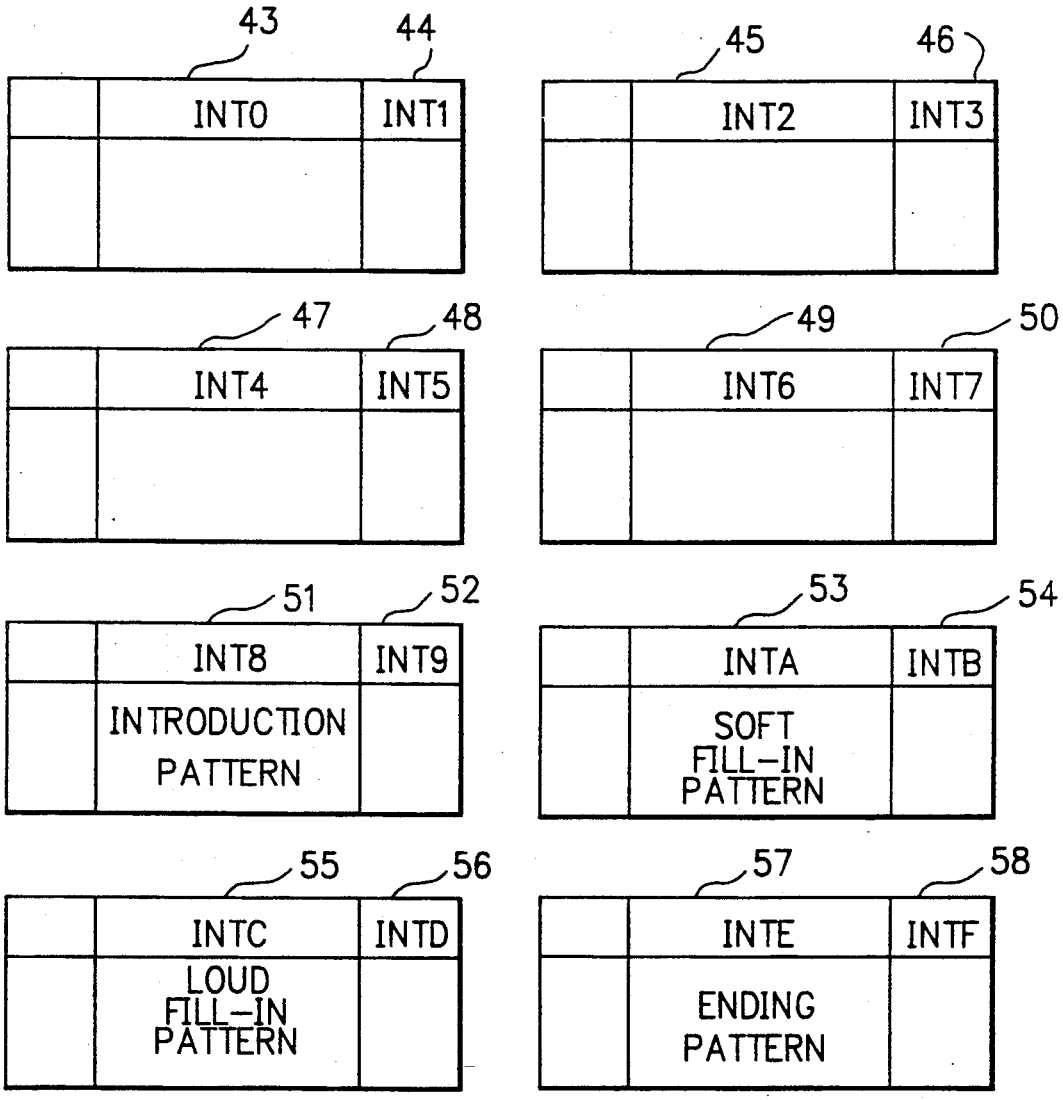
FIG. 5 is a view showing data formats of the intonation pattern data.

FIG. 5 shows formats of intonation pattern data for one rhythm. Sixteen intonation pattern data 43 to 58 are arranged in the order of intonation values INTO to INTF (F=15) corresponding to intonation levels. The intonation pattern data 43 to 50 having the intonation values INT0 to INT7 are used for controlling the intonation. The intonation pattern data 51 to 58 having the intonation values INT8 to INTF are used as sub-phrase patterns including introduction patterns (51 and 52), soft fill-in patterns (53 and 54), loud fill-in patterns (55 and 56), and ending patterns (57 and 58).

The intonation pattern data 34*a* for one level consists of data for designating a tone volume, tone color, type of instrument, and the like, and play pattern data for obtaining an auto-play pattern for several bars. The play pattern data consists of an array of addresses for reading out auto-play data (note data) in the ROM 20. The pattern data 34*a* are set to have different playback tone levels (tone volumes) and different accents in respective parts (chord, bass, and drum parts) according to their levels, i.e., are set to have larger tone-up levels of play tones as the level is increased.

The data format of the sub-phrase pattern data 34*b* is the same as that of the intonation pattern data 34*a*. The soft fill-in patterns (53 and 54) and the loud fill-in patterns (55 and 56) are those for giving a sharp change to the tone-up state of play tones. The loud fill-in pattern (55 or 56) is set to be able to obtain a high tone-up level of play tones by setting the tone volumes of chord, bass, and drum parts to be relatively high. The soft fill-in pattern (53 or 54) is set to suppress the tone-up level of play tones by generating only playback tones of the drum part in a relatively low tone volume.

The tone controller 35 reads out auto-play pattern data from an auto-play data memory 36 on the basis of the play pattern data in the intonation pattern data, changes (modifies) the auto-play data based on the data for designating the tone volume, tone color, type of instrument, and the like, and outputs the modified data to a tone generator 37. The auto-play data memory 36 is allocated on the ROM 20, and stores note data strings for auto-accompaniment tones such as chord, bass, and drum tones in units of rhythms. Each note data consists of key (pitch) number data, tone generation timing data, tone generation duration data, tone volume data, and the like.

The tone generator 37 reads out a corresponding PCM tone source waveform from a waveform ROM 38 on the basis of tone data from the tone controller 35, thus forming tone signals. In this manner, auto-accompaniment tones corresponding to the intonation level can be obtained. The intonation level can be desirably changed by the dial operation.

Note that the intonation value setter 31, the detectors 60 to 62, the director 63, the value changer 4, the pattern selector 65, and the tone controller 35 are realized by a microcomputer system constituted by the CPU 21, the RAM 19, and the ROM 20.

Figure 6:
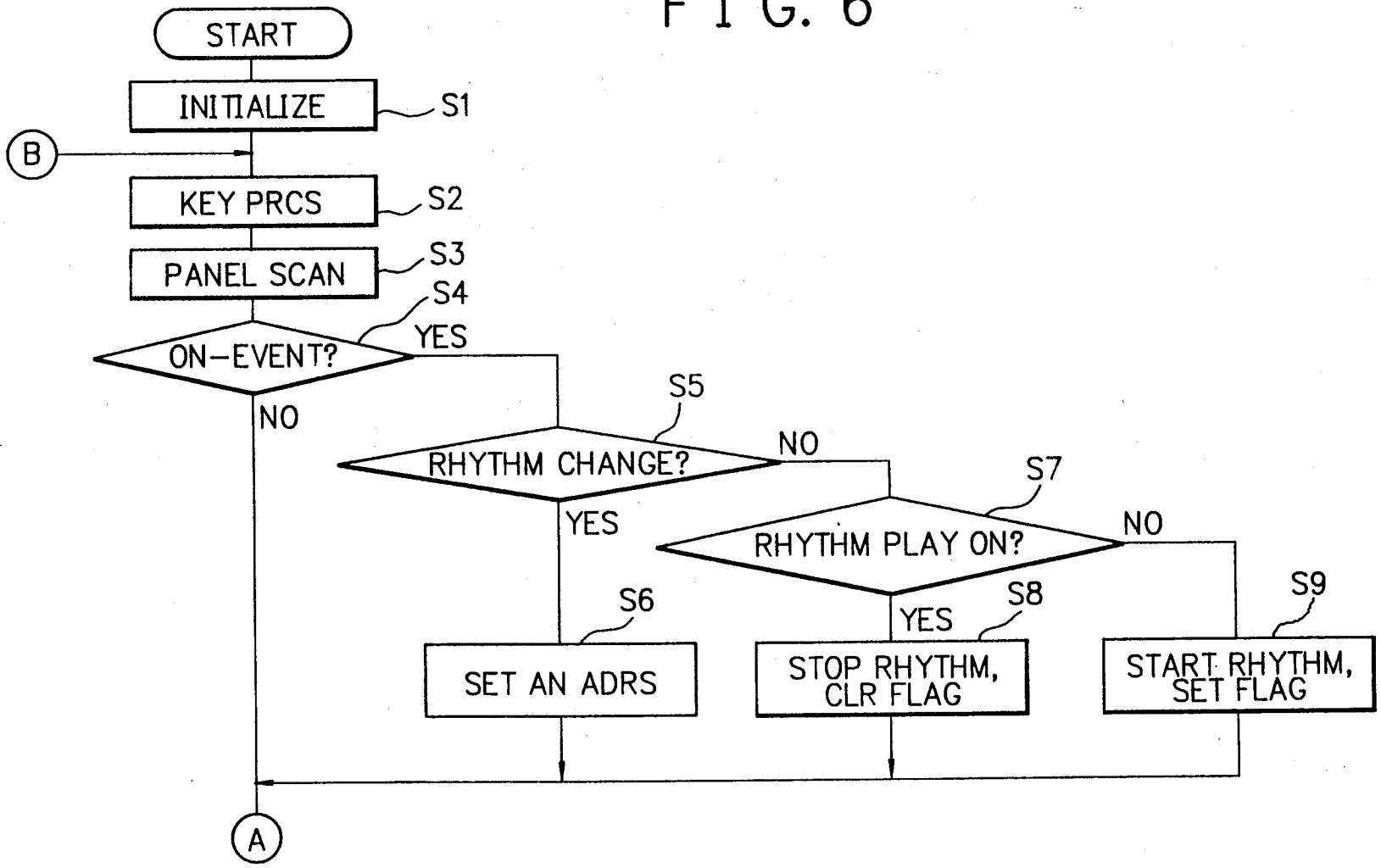
FIGS. 6 to 8 are flow charts showing auto-play control based on the intonation pattern data.
Figure 7:
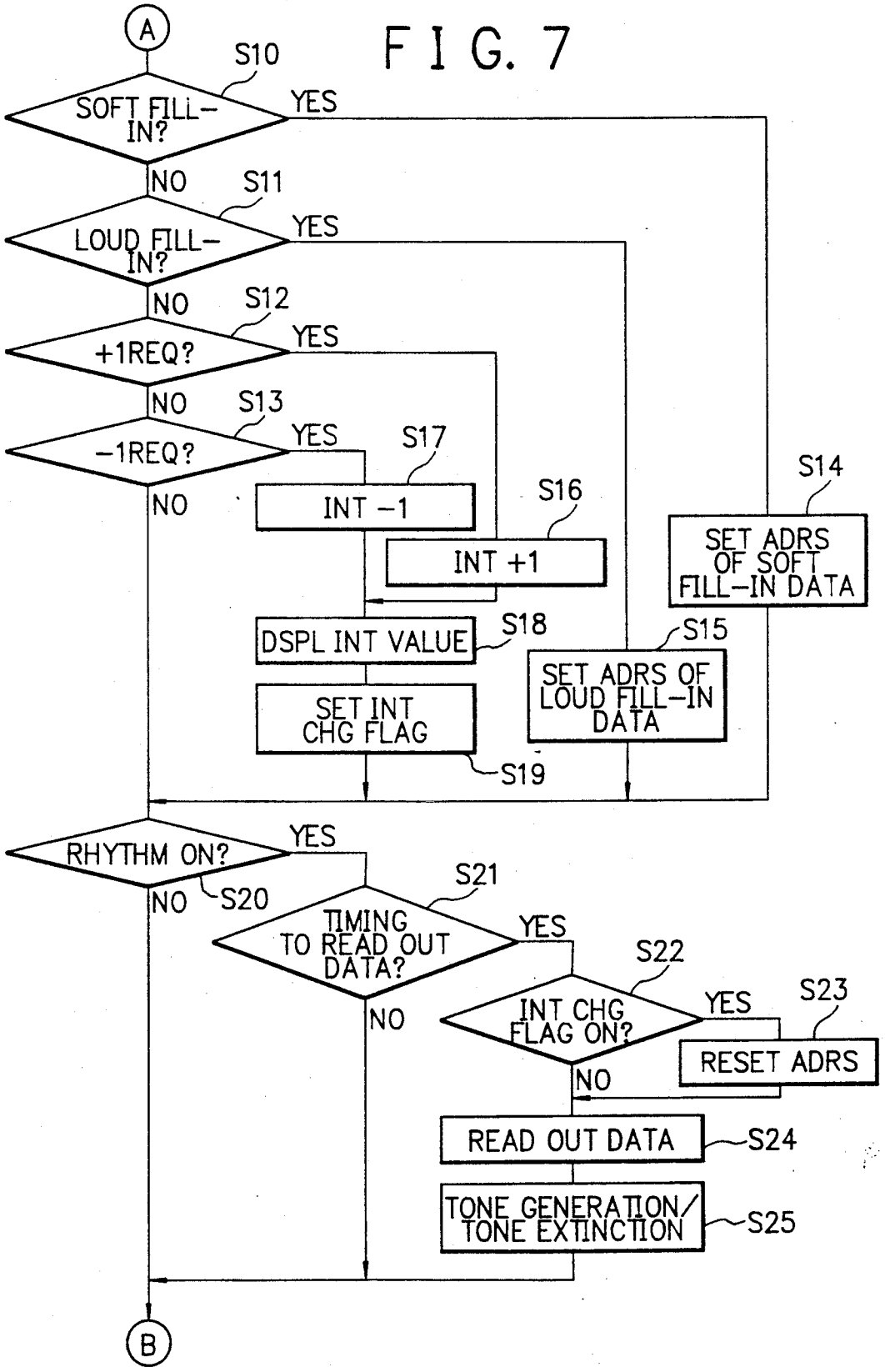

FIGS. 6 and 7 are flow charts showing auto-accompaniment control based on the intonation pattern data.

In step S1, the overall electronic musical instrument is initialized. In step S2, key processing is performed to scan all the keys on the keyboard 11, thus detecting ON or OFF keys. Similarly, in step S3, all the operation members on the operation panel 12 are scanned to detect operated operation members. It is checked in step S4 if an ON event of the operation member on the operation panel 12 is detected. If YES in step S4, it is checked in step S5 if a rhythm change operation is performed. If it is determined in step S5 that the rhythm change operation is performed, i.e., a new rhythm is selected, an address of the memory 34 where a corresponding intonation pattern is stored is set according to the rhythm directed by the operation member and the current intonation value (step S6).

On the other hand, if it is detected in step S5 that the a rhythm start or stop operation is performed, it is checked in step S7 if a rhythm play mode (an auto-accompaniment play mode) is ON. If YES in step S7, the rhythm is stopped and a flag indicating the rhythm play mode is cleared (step S8). However, if NO in step S7, the rhythm play mode is started, and the flag indicating the rhythm play mode is set. Thereafter, the control advances to the next processing (step S9).

In processing in steps S10 to S13, whether a play operation based on the soft fill-in pattern (53 or 54) or the loud fill-in pattern (55 or 56) is directed, or it is directed to increment or decrement the intonation value by "1" is determined with reference to corresponding flags. If it is determined that the play operation based on the soft fill-in pattern (53 or 54) is directed, the start address of the soft fill-in pattern data is set in step S14; if it is determined that the play operation based on the loud fill-in pattern (55 or 56) is directed, the start address of the loud fill-in pattern data is set in step S15. If it is determined as a result of judgment in step S12 or S13 that it is directed to increment or decrement the intonation value, the current intonation value is incremented or decremented by "1" to set a new intonation value in step S16 or S17. In step S18, the new intonation value is displayed on the display 13. In step S19, an intonation value change flag indicating that the intonation value is changed is set, and the flow then advances to step S20.

In step S20, it is checked based on the flag set in step S9 if the auto-accompaniment (rhythm play) mode is ON. If NO in step S20, the flow returns to step S2; otherwise, the flow advances to step S21 to check if a timing to read out data is reached.

If YES in step S21, it is checked in step S22 if the intonation value change flag is set. If YES in step S22, an address for reading out the intonation patterns 34*a* and 34*b* corresponding to the new intonation value set in step S16 or S17 from the memory 34 is set (step S23). If NO in step S22, the intonation pattern data selected at that time is read out from the memory 34, and auto-play data (note data) is read out from the memory 36 on the basis of the readout intonation pattern data in step S24. In step S25, tone generation/tone extinction processing of a corresponding tone is performed. Thereafter, the flow returns to step S2, and the above-mentioned processing is repeated.

Figure 8:
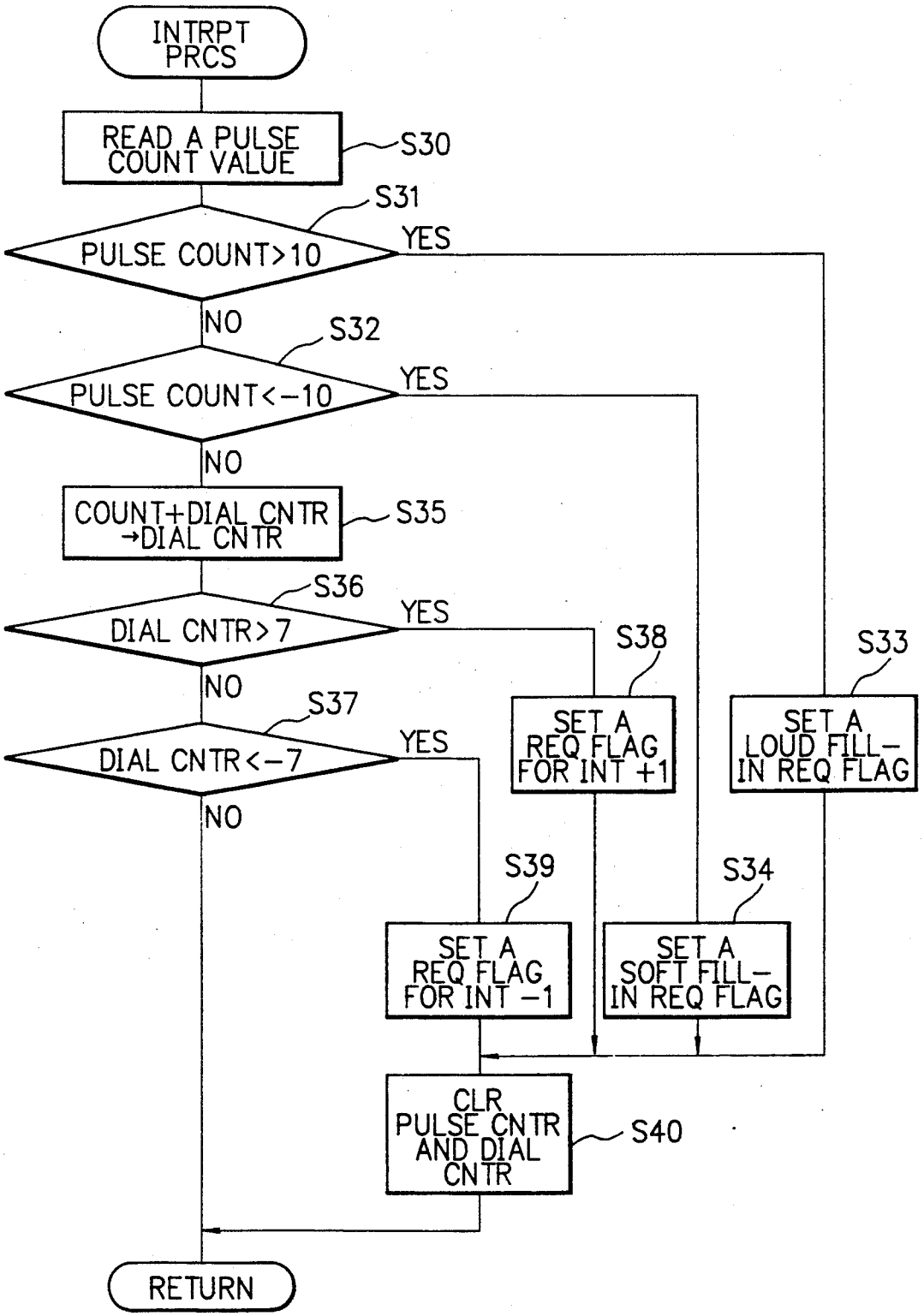

FIG. 8 is a flow chart for explaining interrupt processing executed by the CPU 21 upon operation of the dial 10.

In this processing, in step S30, the count value of output pulses from the pulse generator 14, which value is counted in a predetermined period of time, is read from a pulse counter. In steps S31 and S32, it is checked if the count value is larger than 10 or is smaller than −10. If it is determined that the count value is larger than 10, it is determined that the dial 10 is rotated clockwise at a speed higher than a predetermined speed, and a loud fill-in request flag for directing an auto-play operation based on the loud fill-in pattern (55 or 56) is set in step S33; if it is determined that the count value is smaller than −10, it is determined that the dial 10 is rotated counterclockwise at a speed higher than the predetermined speed, and a soft fill-in request flag for directing an auto-play operation based on the soft fill-in pattern (53 or 54) is set in step S34.

If NO in steps S31 and S32, the flow advances to step S35, and the value of a dial counter for detecting the rotational angle of the dial 10 is set to be a value obtained by adding the current count value of the dial counter and the count value read in step S30. The flow then advances to steps S36 and S37 to check if the value of the dial counter is larger than 7 or smaller than −7. The count value "7" or "−7" corresponds a ⅓ revolution of the dial 10.

If it is determined that the value of the dial counter is larger than 7, it is determined that the dial 10 is rotated clockwise more than a ⅓ revolution, and a flag for directing to increment the intonation value by "1" is set in step S38; if it is determined that the value of the dial counter is smaller than −7, it is determined that the dial 10 is rotated counterclockwise more than a ⅓ revolution, and a flag for directing to decrement the intonation value by "1" is set in step S39. Thereafter, the dial counter and the pulse counter are cleared in step S40, and the flow returns to the main routine.

As described above, according to the above embodiment, when a player wants to sharply change the tone-up level of auto-accompaniment tones, he or she need only quickly (sharply) rotate the dial 10. Then, the soft fill-in pattern (53 or 54) or the loud fill-in pattern (55 or 56) is selected, and an auto-play operation based on the selected pattern is performed (steps S31 to S34 in FIG. 8, and steps S10, S11, S14, and S15 in FIG. 7), thus obtaining play tones having a high tone-up level or a considerably suppressed tone-up level. Therefore, when the player wants to sharply change the tone-up level, he or she need not rotate the dial 10 a number of times to change the intonation value to be a large or small value, resulting in easy operation of the operation member.

The present invention has been described with reference to one embodiment. However, the present invention is not limited to the above-mentioned embodiment, and various effective changes may be made based on the technical principle of the present invention. For example, in the above embodiment, when the dial 10 is sharply rotated, a play operation based on the soft fill-in pattern (53 or 54) or the loud fill-in pattern (55 or 56) is performed, thereby giving a sharp change to the tone-up state of play tones. Alternatively, when the rotational speed detector 60 detects that the dial 10 is rotated at a speed higher than the predetermined speed, the director 63 may direct the value changer 64 to replace the current intonation value with a preset value having a large or small value, thereby sharply changing the intonation value. In addition, the director 63 may direct the value changer 64 to add a positive or negative predetermined large value to the current intonation value, thereby sharply changing the intonation value.

In the above embodiment, when the intonation value is changed, the different intonation patterns 34*a* and 34*b* are selected to change tone parameters. Alternatively, auto-play data having different intonation levels (tone volumes, accents, and the like) may be stored in the auto-play data memory 36. When the intonation value is changed, auto-play data according to the new intonation value may be directly read out from the memory 36 without using the intonation patterns, and an auto-play operation may be performed based on the readout data to change tone parameters.

As described above, according to the present invention, when a player wants to sharply change the tone-up level of play tones, he or she need only rotate the dial-like operation member sharply (at a high speed), so that the tone-up level of the play tones can be sharply changed. For this reason, when the player wants to sharply change the tone-up level of play tones, he or she need only rotate the dial-like operation member through a predetermined angle at a speed higher than the predetermined speed in place of rotating the dial-like operation member a number of times to change the intonation value to be a large or small value. Therefore, an operation for sharply changing the tone-up level of play tones can be quickly performed within a short period of time, and hence, the tone-up level of play tones intended by the player can be easily obtained at his or her intended timing.

What is claimed is:

1. An auto-play musical instrument for generating tones on the basis of programmed auto-play data, comprising a dial-like operation member for changing an intonation value indicating a tone-up level of play tones;

intonation value incrementing/decrementing means for incrementing/decrementing the intonation value according to a rotational angle of said dial-like operation member;

tone parameter modifying means for modifying tone parameters of the auto-play data according to the intonation value set upon operation of said dial-like operation member;

rotational speed detection means for detecting a rotational speed of said dial-like operation member;

play pattern memory means for storing auto-play patterns for tone generation of fill-in pieces, which patterns are used for sharply changing the tone-up level of play tones;

direction means for, when it is determined as a result of detection by said rotational speed detection means that the rotational speed of said dial-like operation member is higher than a predetermined speed, directing an auto-play operation based on the auto-play pattern for tone generation of the fill-in piece, and for, when it is determined that the rotational speed of said dial-like operation member is lower than the predetermined speed, directing said intonation value incrementing/decrementing means to increment/decrement the intonation value; and tone generation means for, when said direction means directs the auto-play operation based on the auto-play pattern for tone generation of the fill-in piece, reading out the auto-play pattern from said play pattern memory means, and performing the auto-play operation on the basis of the readout auto-play pattern.

2. An apparatus according to claim 1, further comprising rotating direction detection means for detecting a rotating direction of said dial-like operation member, and designation means for designating a type of auto-play pattern for tone generation of the fill-in piece to be read out from said play pattern memory means according to the rotating direction of said dial-like operation member detected by said rotating direction detection means.

3. An auto-play musical instrument for performing an auto-play operation on the basis of programmed auto-play data, comprising:

a dial-like operation member for changing an intonation value indicating a tone-up level of play tones;

intonation value incrementing/decrementing means for incrementing/decrementing the intonation value according to a rotational angle of said dial-like operation member;

rotational speed detection means for detecting a rotational speed of said dial-like operation member;

direction means for, when it is determined as a result of detection by said rotational speed detection means that the rotational speed of said dial-like operation member is higher than a predetermined speed, directing to set a preset value as the intonation value, and for, when it is determined that the rotational speed of said dial-like operation member is lower than the predetermined speed, directing said intonation value incrementing/decrementing means to increment/decrement the intonation value;

intonation value setting means for setting the intonation value according to a direction from said direction means; and tone parameter modifying means for modifying tone parameters of the auto-play data according to the intonation value set by said intonation value setting means.

4. An auto-play musical instrument for performing an auto-play operation on the basis of programmed auto-play data, comprising:

a dial-like operation member for changing an intonation value indicating a tone-up level of play tones;

intonation value incrementing/decrementing means for incrementing/decrementing the intonation value according to a rotational angle of said dial-like operation member;

rotational speed detection means for detecting a rotational speed of said dial-like operation member;

direction means for, when it is determined as a result of detection by said rotational speed detection means that the rotational speed of said dial-like operation member is higher than a predetermined speed, directing to add a predetermined value to the intonation value set at that time, and for, when it is determined that the rotational speed of said dial-like operation member is lower than the predetermined speed, directing said intonation value incrementing/decrementing means to increment/decrement the intonation value;

intonation value setting means for setting the intonation value according to a direction from said direction means; and tone parameter modifying means for modifying tone parameters of the auto-play data according to the intonation value set by said intonation value setting means.

* * * * *